United States Patent [19]

Mushardt

[11] Patent Number: 4,607,460

[45] Date of Patent: Aug. 26, 1986

[54] GRINDING MACHINE WITH A RECIPROCABLE COLUMN FOR WORK SUPPORTING DEVICES

[75] Inventor: Heinrich Mushardt, Wechelde, Fed. Rep. of Germany

[73] Assignee: Hauni-Werke Körber & Co. KG, Hamburg, Fed. Rep. of Germany

[21] Appl. No.: 767,411

[22] Filed: Aug. 20, 1985

[30] Foreign Application Priority Data

Apr. 18, 1985 [DE] Fed. Rep. of Germany ..... 3513970

[51] Int. Cl.[4] ..... B24B 51/00

[52] U.S. Cl. ..... 51/165 TP; 51/5 D; 51/96

[58] Field of Search ..... 51/5 D, 96, 97 R, 165 TP, 51/165.71

[56] References Cited

U.S. PATENT DOCUMENTS

| | | | |
|---|---|---|---|
| Re. 28,766 | 4/1976 | Villano | 51/165 TP |
| 3,680,263 | 8/1972 | Johnson | 51/96 |
| 4,186,529 | 2/1980 | Huffman | 51/165 TP |
| 4,461,121 | 7/1984 | Motzer | 51/165.71 |
| 4,550,532 | 11/1985 | Fletcher | 51/165.71 |

FOREIGN PATENT DOCUMENTS 3246168 7/1983 Fed. Rep. of Germany .

*Primary Examiner*—Harold D. Whitehead
*Attorney, Agent, or Firm*—Peter K. Kontler

[57] ABSTRACT

A numerically controlled profile grinding machine has a bed for a first carriage which supports an upright column and is reciprocable along a first horizontal path. The column supports a second carriage which is reciprocable thereon along a vertical second path and supports a turntable which is indexible about a horizontal axis. The turntable supports one or more work clamping devices which are indexible about second axes extending at right angles to and intersecting the first axis. The base further supports a carriage for one or more tool supporting units each of which is movable along a second horizontal path at right angles to the first path and has a turntable indexible about a vertical axis and supporting one or more spindles for grinding wheels as well as a dressing apparatus for grinding wheels. Alternatively, each tool supporting unit can be mounted on a discrete carriage.

20 Claims, 5 Drawing Figures

GRINDING MACHINE WITH A RECIPROCABLE COLUMN FOR WORK SUPPORTING DEVICES

BACKGROUND OF THE INVENTION

The present invention relates to machine tools in general, especially to numerically controlled profile grinding machines, and more particularly to improvements in machine tools of the type wherein a bed supports a reciprocable and indexible tool carrying device and wherein a column or an analogous supporting device is provided with a vertically reciprocable carriage for a workpiece. The following description will deal primarily with profile grinding machines but it will be appreciated that the invention can be embodied with equal or similar advantage in other types of machine tools such as lapping, nibbling and polishing machines.

The grinding of workpieces having complex profiles with a plurality of straight and/or curved parallel or mutually inclined surfaces or facets, shoulders, recesses, grooves, protuberances and/or other irregularities presents many problems to the designer of an automatic grinding machine which is utilized to treat large numbers of workpieces per unit of time. Typical examples of workpieces which must be treated in specially designed grinding machines are turbine blades, guide vanes for use in turbines and like parts which must be machined with an extremely high degree of precision and whose dimensions must match the optimum dimensions irrespective of the number of successively treated workpieces. Furthermore, it is important to ensure that such workpieces be treated economically which necessitates the grinding of a large number of different surfaces and/or facets without changing the position of the workpiece with reference to its holder.

A grinding machine wherein the workpiece is mounted on a carriage which is reciprocable along a vertical path defined by a column and wherein the supporting device for the grinding spindle is reciprocable along a horizontal path and is indexible about a vertical axis is disclosed in German Offenlegungsschrift No. 32 46 168. The machine is only capable of grinding relatively simple turbine blades and analogous workpieces because the number of different mutual positions of the workpiece and the grinding wheel is rather limited. The spindle for the grinding wheel is mounted on a first (transverse) carriage which can be indexed about a vertical axis and is reciprocable relative to a second (longitudinal) carriage which is movably mounted on the bed. The just described mounting of the spindle renders it possible to incline the grinding wheel with reference to the workpiece but the movements of the carriages are complex when the grinding wheel is to be held in inclined position while removing material from the workpiece. The versatility of the just discussed grinding machine is limited because the angle through which the axis of the grinding wheel can be changed is small; otherwise, the grinding wheel cannot be moved into actual contact with a selected portion of the workpiece. It has been found that the machine which is disclosed in the German printed application can treat only a limited number of surfaces or facets on workpieces which are as complex as parts of turbine blades or the like.

U.S. Pat. No. 4,186,529 discloses a grinding machine which is designed for the treatment of cutting tools and wherein the spindle for the grinding wheel is movable along a horizontal path together with a carriage which is mounted on a rotatable column. The work supporting device is mounted on a cross slide which is indexible about a vertical axis and is movable along a longitudinal carriage. The work clamping means is tiltable about a horizontal axis as well as about a second axis which is normal to the horizontal axis. The patented grinding machine is satisfactory for the treatment of lightweight workpieces and for the application of relatively small forces in the course of a grinding operation. This eliminates the grinding of a wide variety of workpieces which must be treated while the grinding wheel is urged against the workpiece with a substantial force, either to remove material from a hard workpiece or to remove large quantities of material per unit of time. One of the reasons for the inability of the patented grinding machine to carry out heavy-duty grinding operations is that the point of contact between the grinding wheel and the workpiece is remote from the horizontal axis about which the work clamping means is tiltable; this entails the generation of pronounced transverse forces which adversely influence the accuracy of treatment, especially when the machine is to urge the grinding wheel and the workpiece into contact with one another under the action of a large force. Accuracy of treatment is one of the most important prerequisites in connection with the grinding of a wide variety of workpieces including turbine blades, portions of guide vanes for use in turbines and the like.

A further grinding machine which is designed to treat selected parts of turbine blades and the like is disclosed in commonly owned U.S. Pat. No. 4,417,422. The construction of the patented machine is basically different from that of the aforediscussed conventional grinding machines.

OBJECTS AND SUMMARY OF THE INVENTION

An object of the invention is to provide a novel and improved machine tool, particularly a numerically controlled profile grinding machine, which is constructed and assembled in such a way that it can complete the treatment of a large number of surfaces on a complex workpiece without any changes in the position of the workpiece relative to its clamping means.

Another object of the invention is to provide a grinding machine wherein the workpiece and the material removing tool or tools can be moved to a practically infinite number of different positions relative to each other.

A further object of the invention is to provide a grinding machine which can complete the treatment of successive workpieces within short intervals of time, even if the treatment involves removal of material from a large number of mutually inclined flat and/or curved surfaces, and which can treat the workpieces with a higher degree of precision than heretofore known grinding machines.

An additional object of the invention is to provide a grinding machine which can treat complex workpieces with a high degree of precision even if the tool is urged against the workpiece with a large force.

Still another object of the invention is to provide a grinding machine which is especially suited for the grinding of parts of turbine blades and the like.

An additional object of the invention is to provide a novel and improved combination of means for supporting and moving the workpieces and the tools in a numerically controlled profile grinding machine.

The invention is embodied in a machine tool, particularly in a numerically controlled profile grinding machine. The improved machine tool comprises a bed, a tool supporting unit which includes a grinding spindle carrying device, a carriage for reciprocating the grinding spindle carrying device relative to the bed along a horizontal first path, means for indexing the grinding spindle carrying device about a substantially vertical first axis, a supporting device (preferably in the form of an upright column), at least one head on the supporting device, a carriage for reciprocating the head relative to the supporting device along a substantially vertical second path, means for indexing the head relative to the supporting device about a substantially horizontal second axis, a work holder which is mounted on the head and is indexible about a third axis extending at right angles to the second axis, and a carriage for reciprocating at least one of the two devices relative to the bed along a substantially horizontal third path which is normal to the first path.

The third axis preferably intersects the second axis and the work holder includes means (e.g., a work clamping assembly) for supporting workpieces (e.g., portions of turbines) in or close to the region where the second and third axes intersect each other.

The supporting device is preferably indexible with reference to the bed about a substantially vertical fourth axis, and the machine tool can further comprise a second head on the supporting device as well as a carriage for reciprocating the second head relative to the supporting device along a substantially vertical fourth path.

The carriage for the grinding spindle carrying device can support two or more grinding spindle carrying devices. Alternatively, the machine tool can comprise a discrete carriage for each grinding spindle carrying device and such discrete carriages can reciprocate along one and the same (first) path or along discrete horizontal fourth paths. In other words, the fourth path or each fourth path can coincide with the first path.

The carriage for the one device can support the supporting device and the machine tool can comprise a further carriage for reciprocating the grinding spindle carrying device relative to the bed along a substantially horizontal path which is normal to the first path. The carriage which reciprocates the grinding spindle carrying device at right angles to the first path can be mounted on the carriage which reciprocates the grinding spindle carrying device along the first path or vice versa.

The machine tool can further comprise a housing (e.g., a housing resembling a gantry) which is mounted on a plate-like support of the grinding spindle carrying device and at least partially confines the bearing or bearings for the grinding spindle on the plate-like support. Such machine tool can further comprise a wheel dressing apparatus and means for reciprocating the apparatus relative to the support substantially radially of the grinding wheel or wheels on the spindle or spindles in the grinding spindle carrying device. The housing can confine a portion of or the entire path for reciprocatory movements of the dressing apparatus, and such housing can further serve as a means for supporting a drive for the grinding spindle or spindles. For example, the drive can comprise a prime mover which is mounted on top of the housing and a toothed belt or other suitable transmission which serves to transmit torque from the output element of the prime mover to the grinding spindle or spindles.

The bed can resemble the letter T, i.e., it can comprise two elongated portions one of which supports the carriage for the supporting device and the other of which supports the carriage or carriages for the grinding spindle carrying device or devices.

The novel features which are considered as characteristic of the invention are set forth in particular in the appended claims. The improved machine tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
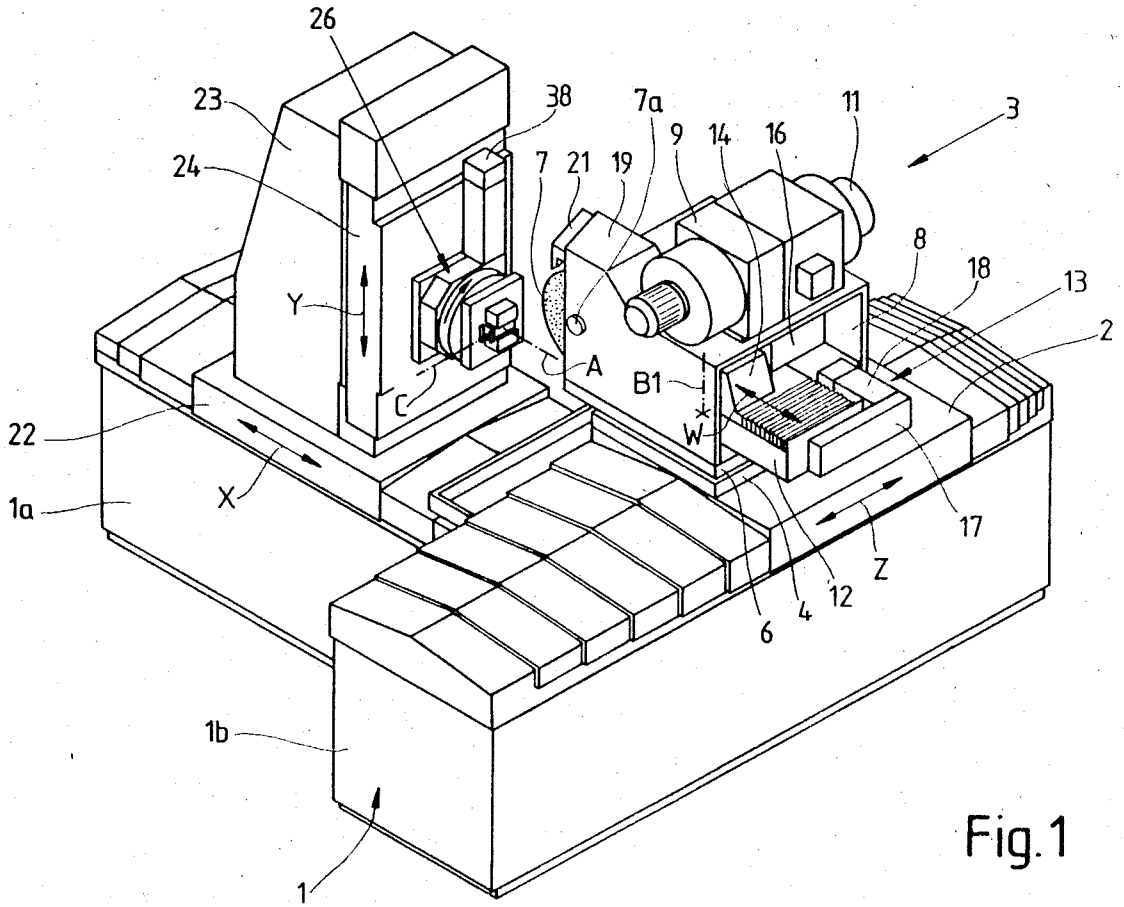
FIG. 1 is a perspective view of a numerically controlled grinding machine which embodies one form of the present invention.

The grinding machine which is shown in FIG. 1 comprises a substantially T-shaped base or bed 1. The leg 1*b* of the bed 1 supports a carriage 2 which serves as a means for reciprocating a grinding spindle carrying device (tool supporting unit) 3 along a horizontal path in directions which are indicated by a double-headed arrow Z. The device 3 is mounted on a turntable 4 which, in turn, is mounted on the carriage 2. The phantom line B1 denotes the vertical axis about which the device 3 is indexible with reference to its carriage 2.

The grinding spindle carrying device 3 comprises a base plate 6 constituting a support for a grinding spindle 7*a* which drives a grinding wheel 7. The base plate 6 of the device 3 further supports a housing or bridge 8 serving as a support for a prime mover 9 which drives the spindle 7*a* for the grinding wheel 7. The means for transmitting torque from the output element of the prime mover 9 (e.g., a variable-speed electric motor) to the spindle 7*a* preferably comprises a toothed belt transmission which is confined in a housing 11. The housing or bridge 8 resembles a gantry and extends transversely across elongated guide means or ways 12 for a reciprocable carriage 14 which supports a dressing apparatus 13. The dressing apparatus 13 is reciprocable with the carriage 14 in directions which are indicated by a double-headed arrow W (i.e., at right angles to the directions of reciprocatory movement of the carriage 2 for the grinding spindle carrying device 3). A prime mover 16 of the dressing apparatus 13 serves to rotate a dressing tool (not specifically shown in FIG. 1) which can be moved into and away from contact with the working surface of the grinding wheel 7. The carriage 14 for the dressing apparatus 13 is reciprocable by a motor 18 through the medium of a transmission which is confined in a housing 17.

The housing for the spindle 7a and for a portion of the grinding wheel 7 is partially surrounded by the bridge 8, and a portion 19 of the bridge 8 constitutes a shroud for the grinding wheel. The shroud 19 supports a nozzle 21 which discharges a suitable liquid coolant when the grinding machine is in use; the jet or jets of coolant are directed against that portion of the grinding wheel 7 which extends from the shroud 19 and comes into contact with the workpiece.

The other leg 1a of the T-shaped bed 1 supports a carriage 22 which is movable in directions indicated by a double-headed arrow X (i.e., at right angles to the directions of reciprocatory movement of the carriage 2) and constitutes a means for reciprocating an upright column 23 constituting a supporting device for a head 26. That side of the supporting device or column 23 which faces the grinding spindle carrying device 3 is provided with vertical ways for a work slide 24 which is reciprocable in directions indicated by a double-headed arrow Y (at right angles to the directions which are indicated by the arrows W, X and Z). The head 26 is mounted at the front side of the work slide 24 for indexing movement of the workpiece about several mutually inclined axes (see the phantom lines A and C).

Figure 2:
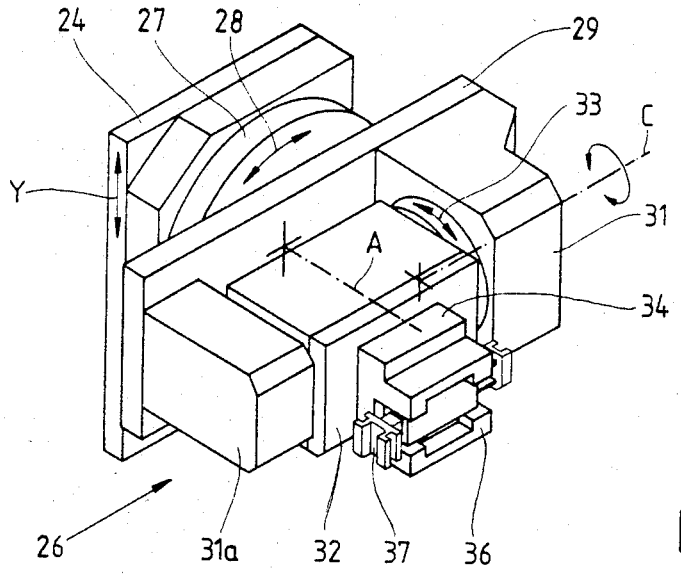
FIG. 2 is an enlarged perspective view of a work supporting head which can be used in the grinding machine of FIG. 1.

The details of the work slide 24 and of the head 26 thereon are shown in FIG. 2. The front side of the work slide 24 carries a holder 27 which is indexible with reference to the slide 24 about the horizontal axis A in directions indicated by a double-headed arrow 28. The holder 27 supports a base plate 29 which forms part of the head 26 and carries two spaced apart bearings 31 and 31a for the stubs (not specifically shown) of a workpiece holder 32. The latter is indexible (note the double-headed arrow 33) about the axis C which is normal to the axis A. The front side of the holder 32 supports a clamping unit 34 including a removable clamping block 36 for a workpiece 37, e.g., a workpiece of the type shown in FIG. 5. The manner of constructing, mounting and removing clamping blocks 36 is disclosed in the commonly owned copending patent applications Ser. Nos. 666,364, filed 10-30-1984, now abandoned and 638,886 filed 8-2-1984.

The drive means for indexing the holder 32 about the axis C is installed in the bearing 31, and the drive means for indexing the holder 27 about the axis A includes a reversible motor 38 (FIG. 1) which is mounted on the work slide 24. The drive means for reciprocating the work slide 24 is installed in the interior of the column 23.

An important advantage of the grinding machine which is shown in FIGS. 1 and 2 is that one of the devices 3, 23 is movable relative to the other device in directions (arrow X) at right angles to the direction (arrow Z) of reciprocatory movement of the device 3 relative to the leg 1b of the bed 1. Another important advantage of the improved grinding machine is that the workpiece 37 is indexible with reference to the work slide 24 about several mutually inclined axes (A and C) which preferably intersect each other in or close to the region where the workpiece 37 is held during removal of material therefrom. This reduces the intervals of time which are required to change the angular position of the workpiece with reference to the material removing tool 7 because the angular distances which the workpiece must cover in order to assume different positions with reference to the tool are relatively small. Another advantage of the aforedescribed mounting of the devices 3, 23 and workpiece 37 is that even the application of highly pronounced grinding forces during removal of material from the workpiece in the clamping unit 34 entails the development of relatively small transverse forces which contributes to greater accuracy of treatment.

The mounting of the prime mover 9 and of the torque transmitting means in the housing 11 on the bridge 8 contributes to compactness of the grinding machine. The compactness of the machine is enhanced still further due to the fact that the path for reciprocatory movements of the dressing apparatus 13 extends in part through the bridge 8 as well as that the shroud 19 for the grinding wheel 7 forms part of the bridge.

Figure 5:
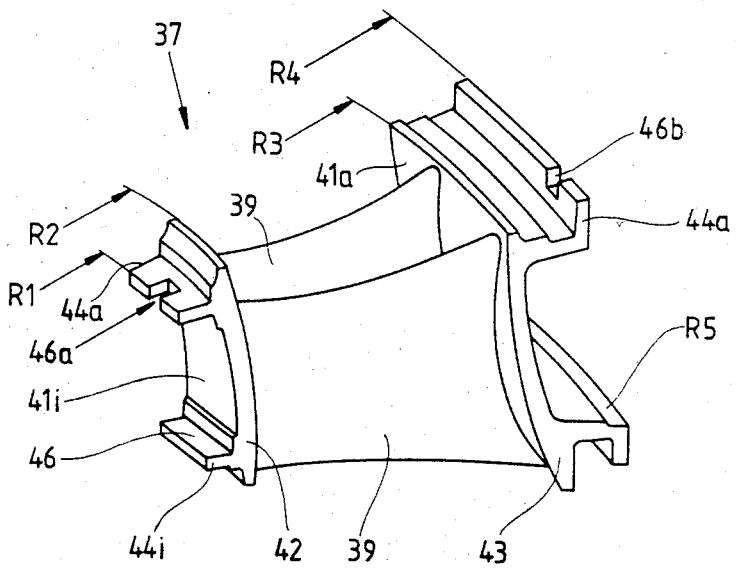
FIG. 5 is a perspective view of a workpiece which can be treated in the improved grinding machine.

The workpiece 37 of FIG. 5 is a typical example of workpieces which can be treated in the grinding machine of the present invention. This workpiece is convertible into a segment-shaped portion of a turbine with two guide vanes 39. The grinding machine is to treat those surfaces of the inner platform 41i which exhibit the radii R1 and R2 as well as the plane lateral surfaces 42 and the surfaces bounding the grooves (if any) in the lateral surfaces 42 of the inner platform. In addition, the grinding machine is to treat those surfaces of the outer platform 41a which exhibit the radii R3, R4 and R5 as well as the plane lateral surfaces 43 and the surfaces bounding the grooves (if any) in the surfaces 43 of the platform 41a. Still further, the machine is to treat the plane surfaces 46 of the inner and outer tongues 44i, 44a and the surfaces bounding the grooves 46a, 46b in such tongues. All such treatments are or can be completed without any changes in the mounting of the workpiece 37 with reference to its clamping block 36. This contributes significantly to the output of the machine as well as to accuracy of treatment of such complex workpieces.

Figure 3:
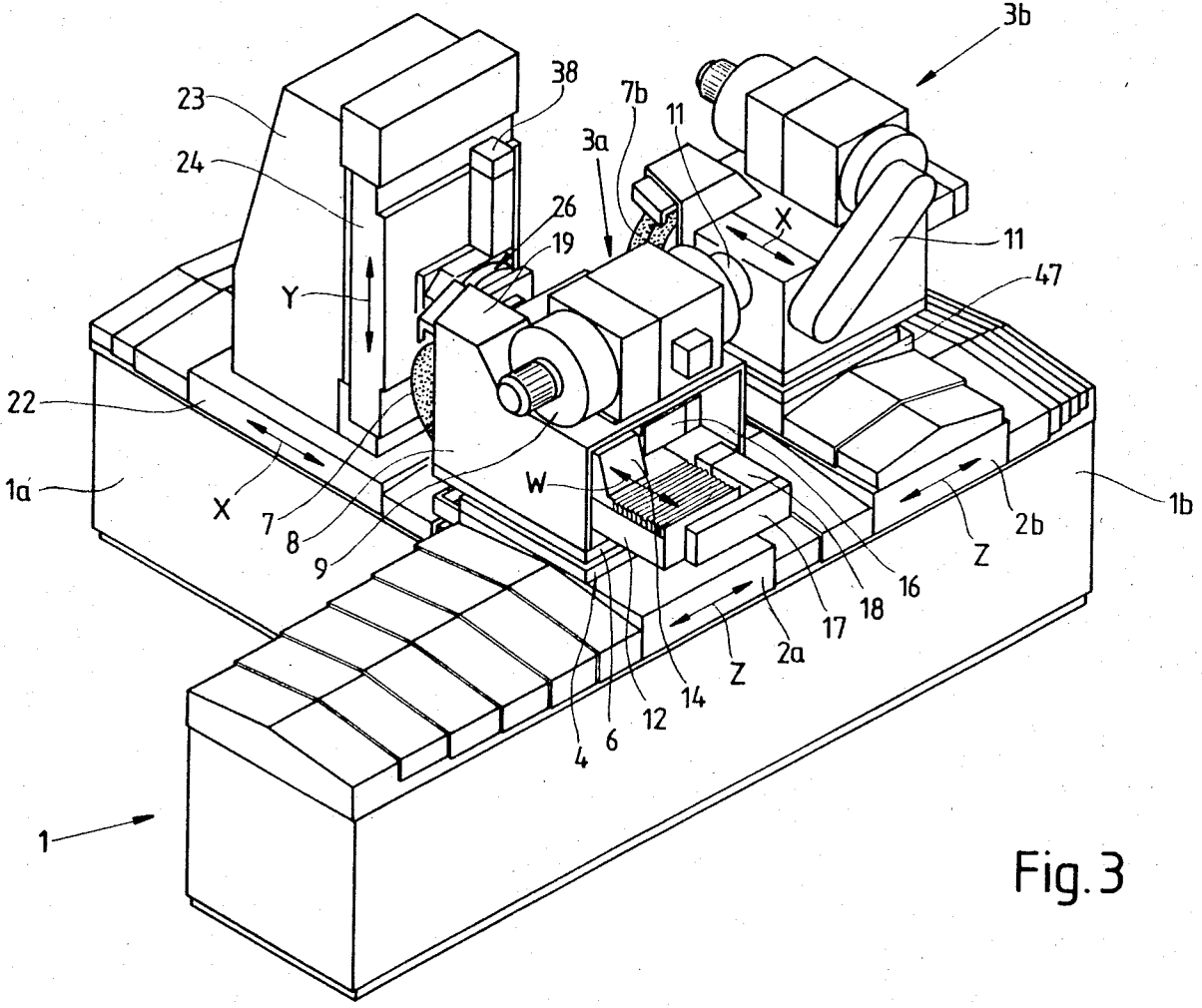
FIG. 3 is a perspective view of a modified grinding machine.

Of course, the improved grinding machine can also be used for precision treatment of a wide variety of other types of workpieces. The workpieces can be ground with a high degree of precision irrespective of the number and nature of surfaces which must be treated and without changing the position of the workpiece with reference to its clamping device. The surfaces can be flat, convex, concave, partly convex and partly concave, internal and/or external. The workpiece 37 of FIG. 3 is rather complex and, due to its intended use in a turbine, the various surfaces on its leg and roof portions must be treated with an extremely high degree of precision. All this can be readily achieved in the improved grinding machine, even if the machine is designed to remove large quantities of material per unit of time. It has been found that the improved grinding machine can properly treat arcuate surfaces whose radii of curvature are greater than the radius or radii of the path or paths along which the workpiece and its clamping device move during indexing about the axis A or C.

FIG. 3 shows a modified grinding machine. All such parts of this machine which are identical with or clearly analogous to the corresponding parts of the machine of FIGS. 1 and 2 are denoted by similar reference characters. The machine of FIG. 3 comprises two discrete carriages 2a, 2b which are reciprocable in directions indicated by double-headed arrows Z and are mounted on the leg 1b of the bed 1. The carriages 2a and 2b respectively support discrete grinding spindle carrying devices 3a and 3b each of which is preferably constructed and mounted on its carriage in the same way as described for the carriage 2 and carrying device 3 of FIG. 1. The carriages 2a and 2b are reciprocable independently of each other and the carriage 2b is equipped with a transverse or cross carriage 47 which is reciprocable thereon in directions indicated by the double-headed arrow X. This enables the machine of FIG. 3 to move the grinding wheel 7b of the device 3b toward and away from the workpiece which is supported by the head 26. The device 3a is indexible about a vertical axis relative to the carriage 2a, and the device 3b is indexible about a vertical axis with reference to the transverse carriage 47. This contributes significantly to the versatility of the grinding machine. The device 3b can be equipped with a grinding wheel 7b for external grinding, and this grinding wheel can be replaced with a grinding wheel (not specifically shown) for the treatment of internal surfaces of workpieces.

Figure 4:
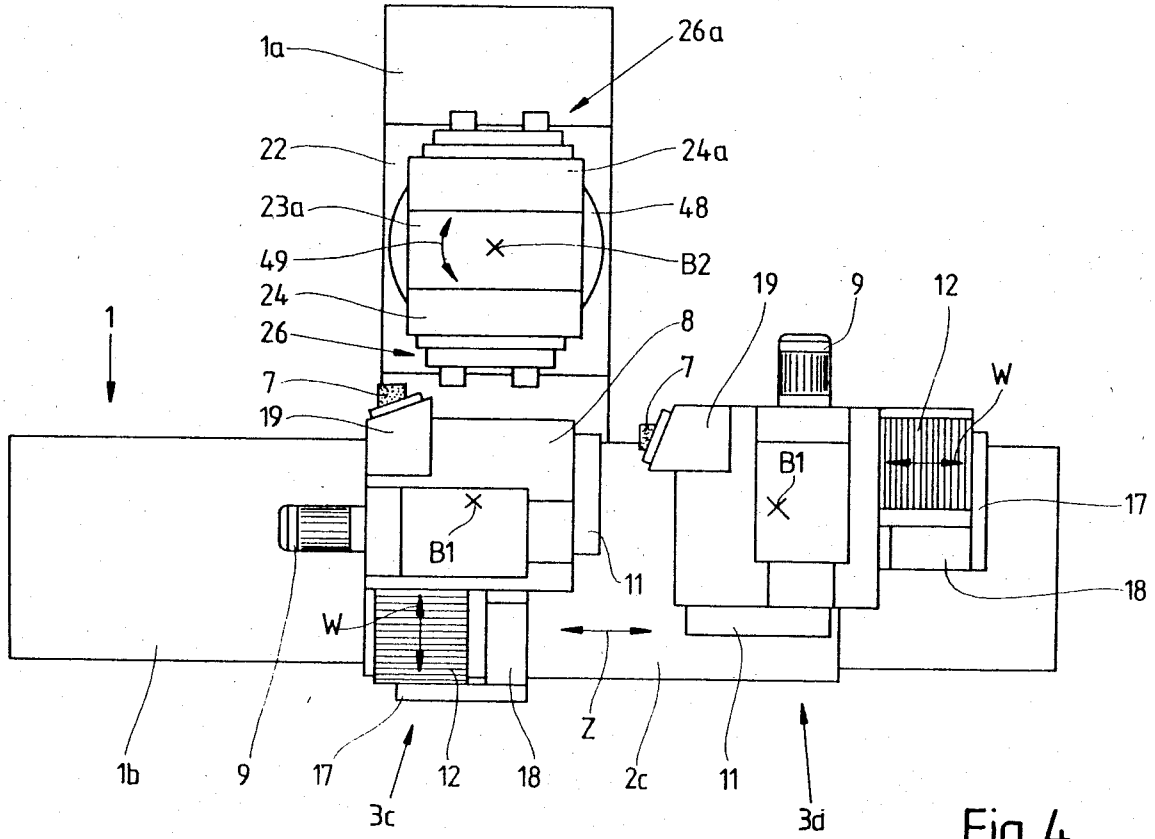
FIG. 4 is a plan view of a third grinding machine.

The grinding machine of FIG. 4 constitutes a modification of the grinding machine which is shown in FIG. 3. All such parts of this machine which are identical with or clearly analogous to the corresponding parts of the machine of FIGS. 1-2 or FIG. 3 are denoted by similar reference characters. The leg 1b of the bed 1 supports a carriage 2c for reciprocatory movement in directions which are indicated by the arrow Z. The carriage 2c supports two discrete grinding spindle carrying devices 3c and 3d each of which is indexible about a discrete vertical axis B1 and each of which is or can be identical with the device 3 of FIG. 1. FIG. 4 shows that the momentary or selected orientation of the device 3d with reference to the device 3c is such that the path of movement of the dressing apparatus relative to the grinding wheel 7 of the device 3d makes an angle of 90 degrees with reference to the path of movement of dressing apparatus for the grinding wheel 7 of the device 3c.

The column 23 is mounted on the carriage 22 through the medium of a turntable 48 which enables the column to turn (note the double-headed arrow 49) relative to the carriage 22 about a vertical axis B2. The head 26 is mounted at one side of the column 23a in the same way as described for the column 23 and head 26 of FIG. 1. In addition, the column 23a supports a second head 26a which is disposed diametrically opposite the head 26 with reference to the vertical axis B2. The second head 26a is mounted on a second vertical work slide 24a which is movable along the respective side of the column 23a at right angles to the plane of FIG. 4. Each of the heads 26, 26a which are shown in FIG. 4 can be identical with the head 26 of FIG. 2. However, it is also possible to provide each of the work holders which are mounted in the heads 26, 26a with a single stub, i.e., to mount each such work holder in cantilever fashion in a single bearing 31 or 31a. This does not result in appreciable alteration of the construction and mounting of the means for supporting the workpieces.

An advantage of the grinding machine which is shown in FIG. 4 is that a finished workpiece can be removed from the head 26a while the head 26 supports a workpiece during removal of material from such workpiece by the grinding wheel 7 of the device 3c or 3d, and vice versa. Moreover, the versatility of the grinding machine of FIG. 4 is greater than that of the machine of FIG. 1 because the carriage 2c supports two discrete grinding spindle carrying devices 3c, 3d each of which is indexible about a discrete vertical axis. The output of the grinding machine of FIG. 4 is surprisingly high because the duration of intervals between treatments of successive workpieces is reduced to a minimum.

The column 23a of the grinding machine which is shown in FIG. 4 can support three or more discrete work slides each of which then carries a discrete head. This enhances the versatility of the machine and is particularly desirable if the removal of a finished workpiece and the attachment of a fresh (untreated) workpiece to a head takes up more time than the treatment of a workpiece in the head which faces the carriage 2c. The utilization of a column with two or more heads thereon further enhances the versatility of the grinding machine because the number of different positions which a workpiece can assume relative to the grinding wheel(s) is increased accordingly. This is attributable primarily to the ability of the column 23a to perform indexing movements with reference to its carriage 22.

An advantage which is common to the grinding machines of FIGS. 3 and 4 is that a workpiece can be treated by several different grinding wheels practically without any interruption of treatment. Thus, each of the devices 3a, 3b or 3c, 3d can support a different grinding wheel and one of these grinding wheels need not be removed from the machine when the other grinding wheel is being put to use (or vice versa). The versatility of the improved grinding machine is enhanced still further if the carriage 2a and/or 2b of FIG. 3 supports two or more grinding spindle carrying devices or if the carriage 2c of FIG. 4 supports three or more devices 3c or 3d. Still further, the leg 1b of the bed 1 in the grinding machine of FIG. 3 can support three or more discrete carriages (corresponding to the carriage 2a or 2b) each of which can support a single grinding spindle carrying device or two or more grinding spindle carrying devices. All such discrete carriages are preferably movable relative to each other to thus further enhance the versatility of the grinding machine. An additional advantage of a grinding machine with two or more grinding spindle carrying devices is that it is possible to replace or to dress one or more grinding wheels while a selected grinding wheel is in the process of removing material from a workpiece. Such mode of constructing and operating the grinding machine further reduces the intervals of idleness and thus contributes to higher output of the machine. At least one of the grinding spindle carrying devices on the leg 1b of the bed 1 of the machine shown in FIG. 3 or 4 is preferably movable in the directions which are indicated by the arrow X so as to still further enhance the versatility of the machine.

The stability of each of the illustrated grinding machines is so high that they can be used for operation with pronounced grinding pressures, i.e., for removal of large quantities of material from workpieces per revolution of the grinding wheel or grinding wheels. Such stability is achieved without risking a reduction in the quality of treatment, even if the machine is designed to turn out large or extremely large numbers of finished products per unit of time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine tool, particularly a numerically controlled profile grinding machine, comprising a bed; a grinding spindle carrying device on said bed; means for reciprocating said device with reference to said bed along a substantially horizontal first path; means for indexing said device about a substantially vertical first axis; a supporting device on said bed; a head on said supporting device; means for reciprocating said head relative to said supporting device along a substantially vertical second path; means for indexing said head relative to said supporting device about a second axis; a work holder mounted on said head and indexible about a third axis which is at least substantially normal to said second axis; and means for reciprocating at least one of said devices along a substantially horizontal third path which is normal to said first path.

2. The machine tool of claim 1, wherein said third axis intersects said second axis.

3. The machine tool of claim 2, wherein said work holder includes means for supporting workpieces in or close to the region where said third axis intersects said second axis.

4. The machine tool of claim 1, wherein said one device is said supporting device.

5. The machine tool of claim 4, wherein said means for reciprocating said one device includes a carriage which is reciprocable with reference to said bed.

6. The machine tool of claim 1, wherein said supporting device is indexible with reference to said bed about a substantially vertical fourth axis.

7. The machine tool of claim 6, further comprising a second head on said supporting device and means for reciprocating said second head relative to said supporting device along a substantially vertical fourth path.

8. The machine tool of claim 1, wherein said means for reciprocating said grinding spindle carrying device comprises a carriage and further comprising a second grinding spindle carrying device on said carriage.

9. The machine tool of claim 1, further comprising a second grinding spindle carrying device on said bed, and means for reciprocating said second grinding spindle carrying device with reference to said bed along a substantially horizontal fourth path.

10. The machine tool of claim 9, wherein said fourth path coincides with said first path.

11. The machine tool of claim 1, further comprising means for reciprocating said grinding spindle carrying device along a substantially horizontal fourth path which is normal to said first path.

12. The machine tool of claim 11, wherein one of the means for reciprocating said grinding spindle carrying device is mounted on the other of such reciprocating means.

13. The machine tool of claim 1, wherein said carrying device comprises a support and further comprising a grinding wheel supporting spindle rotatably mounted on said support, a dressing apparatus, and means for reciprocating said apparatus with reference to said support substantially radially of the grinding wheel on said spindle.

14. The machine tool of claim 13, further comprising a housing provided on said support and confining at least a portion of the path of reciprocatory movement of said apparatus, and a drive provided on said housing and arranged to transmit torque to said spindle.

15. The machine tool of claim 14, wherein said drive includes a prime mover and a transmission interposed between said prime mover and said spindle.

16. The machine tool of claim 14, further comprising a bearing for said spindle, at least a portion of said bearing being mounted in said housing and said housing including a portion constituting a shroud for the grinding wheel on said spindle.

17. The machine tool of claim 1, further comprising means for reciprocating the other of said devices along a substantially horizontal fourth path which is normal to said first path.

18. A machine tool, particularly a numerically controlled profile grinding machine, comprising a bed; a column; a first carriage supporting said column and reciprocable relative to said bed along a horizontal first path; a work clamping device; a second carriage for reciprocating said clamping device relative to said column along a vertical second path; means for indexing said clamping device with reference to said second carriage about a plurality of mutually inclined axes; a tool supporting unit; a third carriage supporting said unit and reciprocable relative to said bed along a horizontal third path which is normal to said first path; and means for indexing said unit with reference to said third carriage about at least one axis.

19. The machine tool of claim 18, wherein said bed includes a first elongated portion supporting said first carriage and a second elongated portion normal to said first portion and supporting said third carriage.

20. The machine of claim 18, further comprising an apparatus for dressing the grinding wheel or wheels which are carried by said unit, said dressing apparatus being mounted on and being movable relative to said third carriage.

* * * * *